US007413185B2

(12) United States Patent
Mitsuya et al.

(10) Patent No.: US 7,413,185 B2
(45) Date of Patent: Aug. 19, 2008

(54) PAPER SHEET TAKEOUT APPARATUS

(75) Inventors: Yusuke Mitsuya, Yokohama (JP); Shinichi Ito, Kawasaki (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 279 days.

(21) Appl. No.: 11/132,416

(22) Filed: May 19, 2005

(65) Prior Publication Data

US 2005/0258592 A1 Nov. 24, 2005

(30) Foreign Application Priority Data

May 20, 2004 (JP) ..... 2004-150632

(51) Int. Cl.
*B65H 3/52* (2006.01)

(52) U.S. Cl. ..... 271/125; 271/121; 271/110

(58) Field of Classification Search ..... 271/149, 271/150, 152, 153, 154, 155, 121, 122, 125, 271/110

See application file for complete search history.

(56) References Cited

U.S. PATENT DOCUMENTS 5,224,695 A 7/1993 Svyatsky et al.
6,508,465 B1 * 1/2003 Endo ..... 271/265.01
6,788,440 B1 9/2004 Sashida

FOREIGN PATENT DOCUMENTS

| | | | |
|---|---|---|---|
| EP | 1 367 015 A2 | | 12/2003 |
| JP | 61-166447 | * | 7/1986 |
| JP | 2000-289865 | | 10/2000 |
| JP | 2003-341860 A | | 12/2003 |

OTHER PUBLICATIONS

European Search Report dated Sep. 6, 2007 for Appln. No. 05010873.7-1256.

* cited by examiner

*Primary Examiner*—Patrick Mackey
*Assistant Examiner*—Thomas A Morrison
(74) *Attorney, Agent, or Firm*—Pillsbury Winthrop Shaw Pittman, LLP

(57) ABSTRACT

A paper sheet takeout apparatus has a memory which has several processing modes, and stores parameters of a supply speed of a supply unit, a pressing force of a delivering roller and a separating force of a separating roller for each processing mode, a setting unit which selects one of several processing modes, and a controller which reads the parameters from the memory in accordance with the processing mode selected by the setting unit and which controls at least one of supply speed of the supply unit, a pressing force of a delivering roller and a separating force of the separating roller, on the basis of the parameters read from the memory.

8 Claims, 10 Drawing Sheets

PAPER SHEET TAKEOUT APPARATUS

CROSS-REFERENCE TO RELATED APPLICATIONS

This application is based upon and claims the benefit of priority from prior Japanese Patent Application No. 2004-150632, filed May 20, 2004, the entire contents of which are incorporated herein by reference.

BACKGROUND OF THE INVENTION

1. Field of the Invention

The present invention relates to a paper sheet takeout apparatus applied to a machine to classify paper sheets such as postal matter.

2. Description of the Related Art

An example of a paper sheet takeout apparatus is disclosed in Jpn. Pat. Appln. KOKAI Publication No. 2003-341860.

In this paper sheet takeout apparatus, parameters such as a medium supply speed, a pressing force of a delivering roller and a separating force of a separating roller are set to certain fixed values suitable for media having average thickness and weight to permit handling of various media, even if media of 0.15-6 mm thick and 2-50 g weight is mixed and supplied.

However, if a thick (heavy) medium 101 as shown in FIG. 12A is supplied to such an apparatus with certain parameters settings, it takes long time to send a succeeding medium 101*b* to a delivering roller 102 and decreases a processing efficiency. A thick medium 101*a* is heavy, and a delivering force of the delivering roller 102 is not sufficiently transmitted to the media, and a processing efficiency is decreased. Further, a separating force of a separating roller 104 (FIG. 13A) serves as resistance and decreases a processing efficiency.

Contrarily, when a thin (light) medium 103 as shown in FIG. 3A is supplied, the medium is fed more than needed and pressed to the delivering roller 102 by a force larger than a predetermined value. Further, a delivering force of the delivering roller 102 is added, and the medium is fed as a batch or in being overlapped. A separating force of the separating roller 104 acts overly as shown in FIG. 13B, and a paper jam occurs and the apparatus stops for long time.

As described above, in a conventional paper sheet takeout apparatus, control parameters are fixed to certain values and various media can be evenly handled. But, when only a special medium of the same kind (thick or thin medium) is supplied, stable takeout is impossible and a processing efficiency is decreased.

BRIEF SUMMARY OF THE INVENTION

The present invention has been made in order to solve the above problem. It is an object of the present invention to provide a paper sheet takeout apparatus, which can stably take out only one kind of special medium (thick or thin medium) as well as mixed various kinds of media.

According to an aspect of the present invention, there is provided a paper sheet takeout apparatus comprising a supply device which supplies a stack of paper sheets in a stacking direction; a delivering roller which contacts paper sheets supplied from the supply device, rotates and delivers the paper sheets; a pressure device which presses the delivering roller to the paper sheets; a feeding roller which rotates in a first direction and feeds the paper sheets delivered from the delivering roller; a separating roller which is pressed by the feeding roller, given a rotation torque in a second direction reverse to the first direction, and separates the paper sheets; a storage device which has several processing modes, and stores parameters of a supply speed of the supply device, a pressing force of the pressure device and a separating force of the separating roller for each processing mode; a mode selector device which selects one of the processing modes; and a control device which reads the parameters from the storage device in accordance with the processing mode selected by the mode selector device and which controls at least one of supply speed of the supply device, a pressing force of the pressure device and a separating force of the separating roller, on the basis of the parameters read from the storage device;

According to another aspect of the present invention, when the operator previously selects a processing mode, a supply speed of a supply unit, a pressing force of a delivering roller, and a separating force of a separating roller are set to values suitable for a selected medium, and stable takeout is possible without decreasing a processing efficiency.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Embodiments of the present invention will be explained hereinafter with reference to the accompanying drawings.

Figure 1:
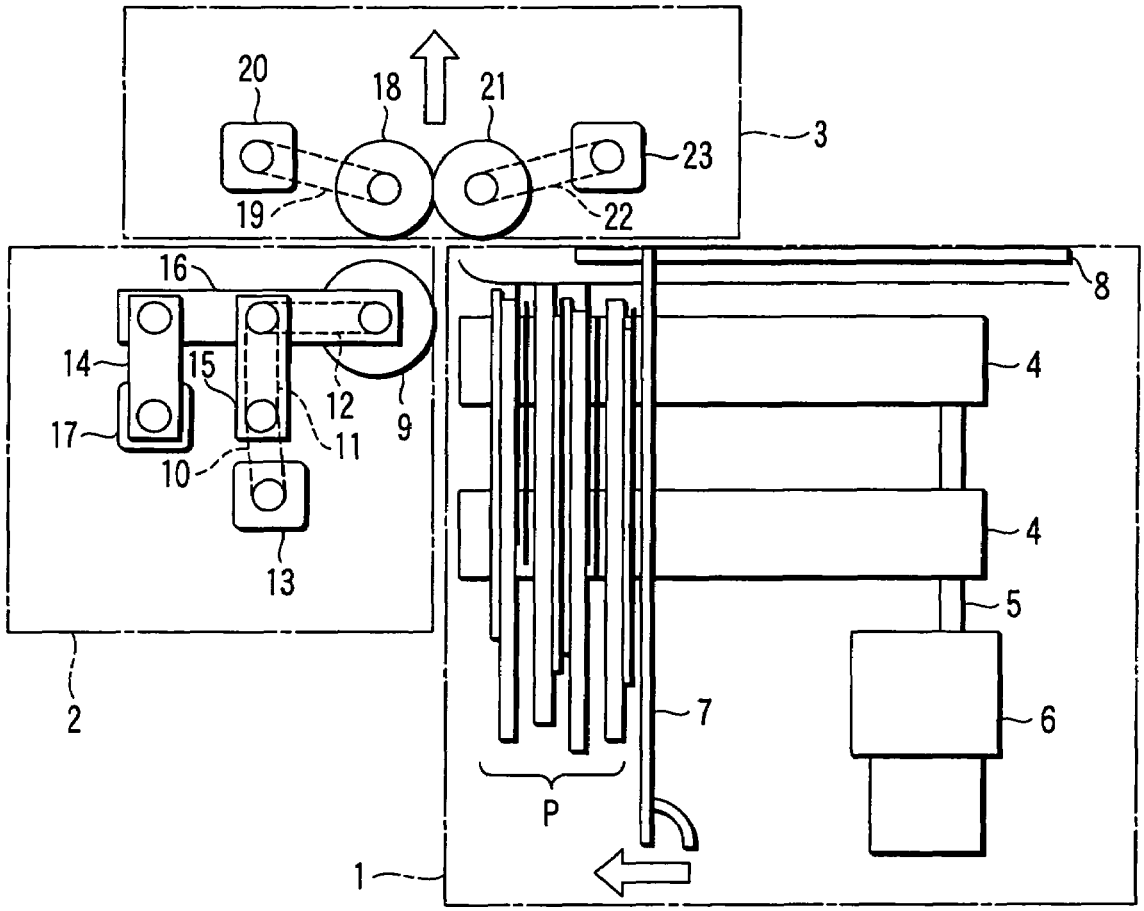
FIG. 1 is a plane view of a paper sheet takeout apparatus according to an embodiment of the present invention.
Figure 2:
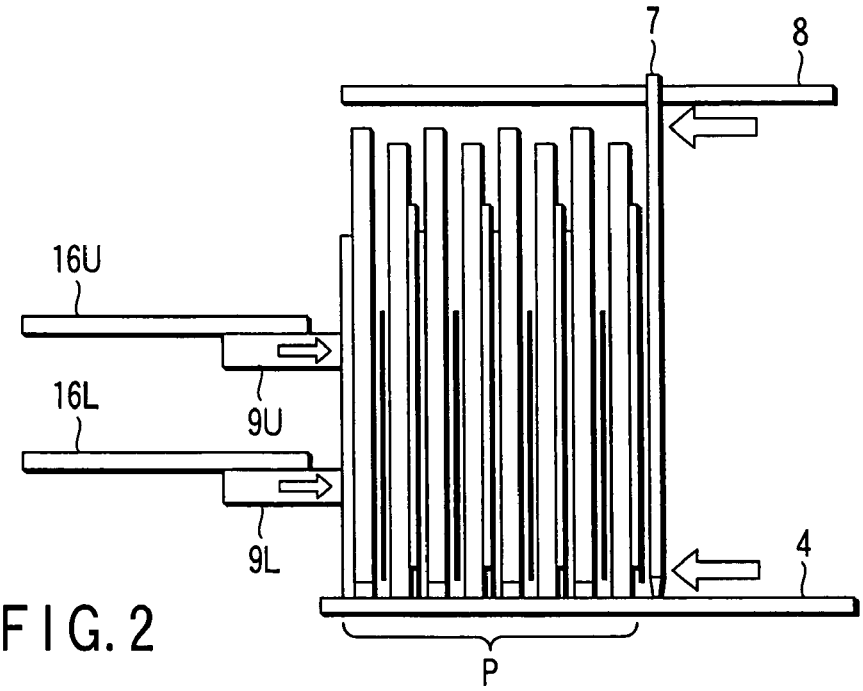
FIG. 2 is a front view of the paper sheet takeout apparatus.

FIG. 1 is a plane view of a paper sheet takeout apparatus according to a first embodiment of the present invention. FIG. 2 is a front view of the apparatus.

The paper sheet takeout apparatus comprises a supply unit 1 as a paper sheet P supplying device, a delivery unit 2 which delivers a paper sheet P supplied from the supply unit 1, and a separation unit 3 which separates and feeds the paper sheet P delivered from the delivery unit 2 one by one.

The supply unit 1 has a floor belt 4. A stack of paper sheet P is stood and placed on the floor belt 4. The floor belt 4 is laid over a pulley (not shown) along the stacking direction of the paper sheet P. A rotary axis 5 of the pulley is connected with a floor motor 6 to drive the floor belt 4 in the stacking direction of the paper sheet P.

The upper surface portion of the floor belt 4 is simply joined with a backup plate 7. The backup plate 7 pushes the paper sheet P from the backside and moves in the paper sheet P stacking direction, when the floor belt 4 is moved. The backup plate 7 is slidably attached to a guide rail 8 provided along the paper sheet P stacking direction.

The delivery unit 2 is provided at one end of the stacking direction of the paper sheet P set in the supply unit 1. The delivery unit 2 has a delivering roller 9, which is connected to a delivery motor 13 through a first timing belt 10, a second timing belt 11 and a third timing belt 12. The delivery motor 13 rotates the delivering roller 9, and the paper sheet P is delivered toward the separation unit 3.

The delivering roller 9 consists of an upper roller 9U to contact the upper side of the paper sheet P, and a lower roller 9L to contact the lower side of the paper sheet P, as shown in FIG. 2. The upper and lower rollers 9U and 9L are pressed to the paper sheet P by a predetermined pressing force of the third delivery arm 16. The predetermined pressing force mentioned here is a force given by the rollers 9U and 9L to the paper sheet.

A first delivery arm 14, a second delivery arm 15 and a third delivery arm 16 form a parallel link mechanism, and control the delivering roller 9 swinging direction to the paper sheet P stacking direction. The first delivery arm 14 is connected to a delivery arm motor 17 as a pressing device to drive the arm. The delivery arm motor 17 uses a torque-controlled servomotor, and holds the paper sheet P pressing force of the delivering roller 9 almost constant.

The separation unit 3 is located in the downstream side of the paper sheet delivering direction of the delivery unit 2. The separation unit 3 has a feeding roller 18, which is connected to a feeding motor 20 through a timing belt 19. The feeding roller 18 is rotated by the feeding motor 20 to feed the paper sheet P.

A separating roller 21 is pressed to the feeding roller 18 by a predetermined pressing force. The separating roller 21 is connected to a separation motor 23 through a timing belt 22. The separation motor 23 uses a torque-controlled servomotor. The separation motor 23 is given a reverse torque to rotate the separating roller 21 reverse to (in a second direction) the paper sheet P feeding direction (a first direction).

The separation motor 23 holds the tangential force (separating force) of the separating roller 21 to the paper sheet P almost constant by outputting a certain torque. The separating roller 21 usually rotates in the feeding direction together with the feeding roller 18, but the separating force is always given in the reverse direction and generated for the second and following paper sheet P not to be fed two or more at a time.

In the paper sheet takeout apparatus configured as above, the paper sheet P stood and set on the floor belt 4 is conveyed and supplied by the floor belt 4 and backup plate 7 toward the delivery unit 2 (in the direction of the arrow in FIG. 1). The supplied paper sheet P contacts the delivering roller 9, and is delivered to the separation unit 3 by the rotation of the delivering roller 9. In the separation unit 3, the separating roller 21 having a separating force controls the second and following paper sheets P not to be fed two or more at a time. The paper sheet P separated one by one in the separation unit 3 is fed further to the downstream side (in the direction of the arrow in FIG. 1).

Figure 3:
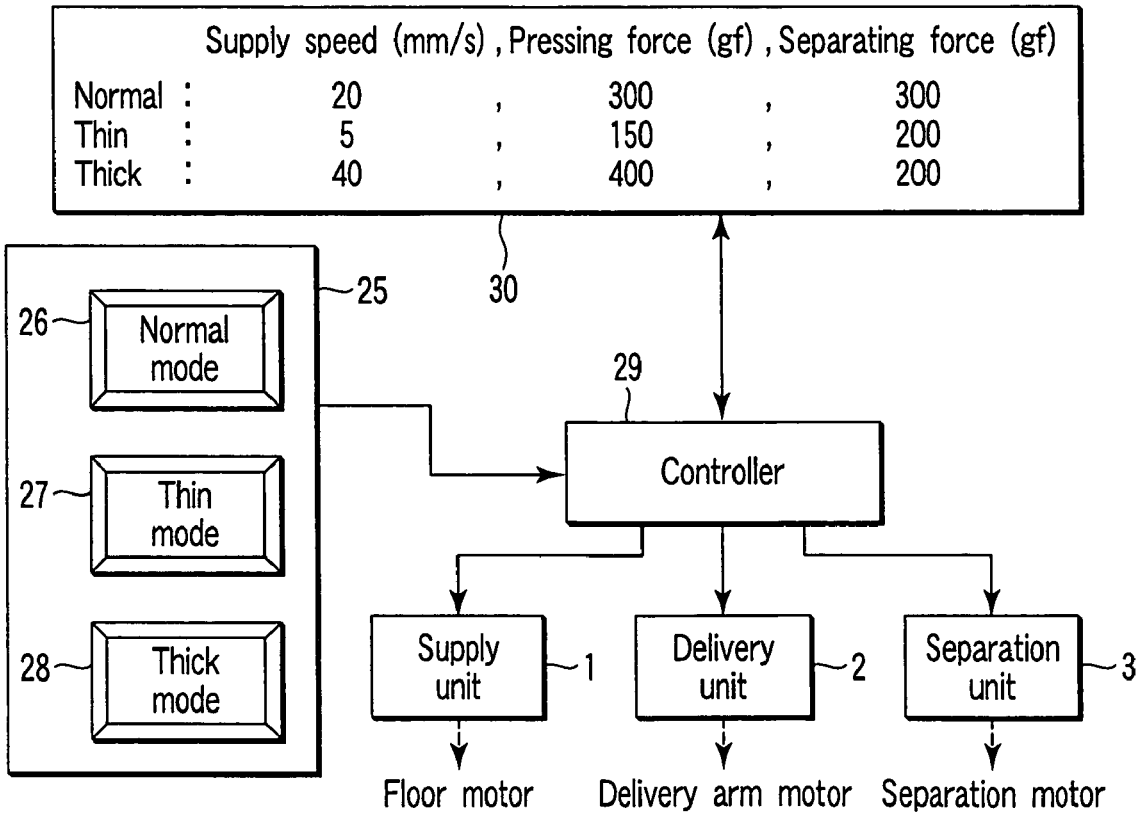
FIG. 3 is a block diagram of a control system for setting paper sheet takeout conditions of the same embodiment.

FIG. 3 is a block diagram of the control system for setting paper sheet takeout conditions.

A reference numeral 25 in FIG. 3 denotes a setting unit as a mode selector device. This setting unit 25 has a first selector switch 26, a second selector switch 27 and a third selector switch 28. The first selector switch 26 selects a normal mode, the second selector switch 27 selects a thin mode, and the third selector switch 28 selects a thick mode.

The normal mode is selected when handling various kinds of paper sheets (e.g., 0.15-6 mm thick and 2-50 g weight) supplied in being mixed.

The thin mode is selected when handling a paper sheet P so-called a thin paper sheet (less than 0.5 mm or 10 g) supplied in a bulk state (only one kind).

The thick mode is selected when handling a paper sheet P so-called a thick paper sheet (more than 0.3 mm or 30 g) supplied in a bulk state.

Usually, various mixed paper sheets are supplied and handled, and a normal mode is default.

The setting unit 25 is connected with a controller 29 as a control device through a signal circuit. When one of the first, second and third selector switches 26, 28 and 28 is pressed and a processing mode is selected, the selected information is sent from the setting unit 25 to the controller 29.

The controller 29 is connected with a memory 30 as a storage device. The memory 30 previously stores a supply speed instruction parameter to the floor motor 6 according to kinds of the paper sheet P, a pressing force instruction parameter to the delivery arm motor 17, and a separating force instruction parameter to the separation motor 23. When the selected processing mode is sent to the controller 29, the parameters corresponding to that processing mode are selected and set.

Concretely, a supply speed of 20 mm/s, a pressing force of 300 gf and a separating force of 300 gf are set for the normal mode. A supply speed of 5 mm/s, a pressing force of 150 gf and a separating force of 200 gf are set for the thin mode. A supply speed of 40 mm/s, a pressing force of 400 gf and a separating force of 200 gf are set for the thick mode.

The parameter settings in the normal mode are for averaged processing of various kinds of paper sheets P. In the thin mode handling thin media, a supply speed is set slow, a pressing force is set small to prevent a batch delivery, and a separating force is set small to prevent an excessive separation force. Parameters are set suitable for handling thin medium. In the thick mode handling thick media, a supply speed is set fast, a pressuring force is set large to be able to feed thick media, and a separating force is set small to prevent resistance. Parameters are set suitable for handling thick media.

Based on the selected parameter settings, the controller 29 controls the driving of the floor motor 6, delivery arm motor 17 and separation motor 23.

Figure 4:
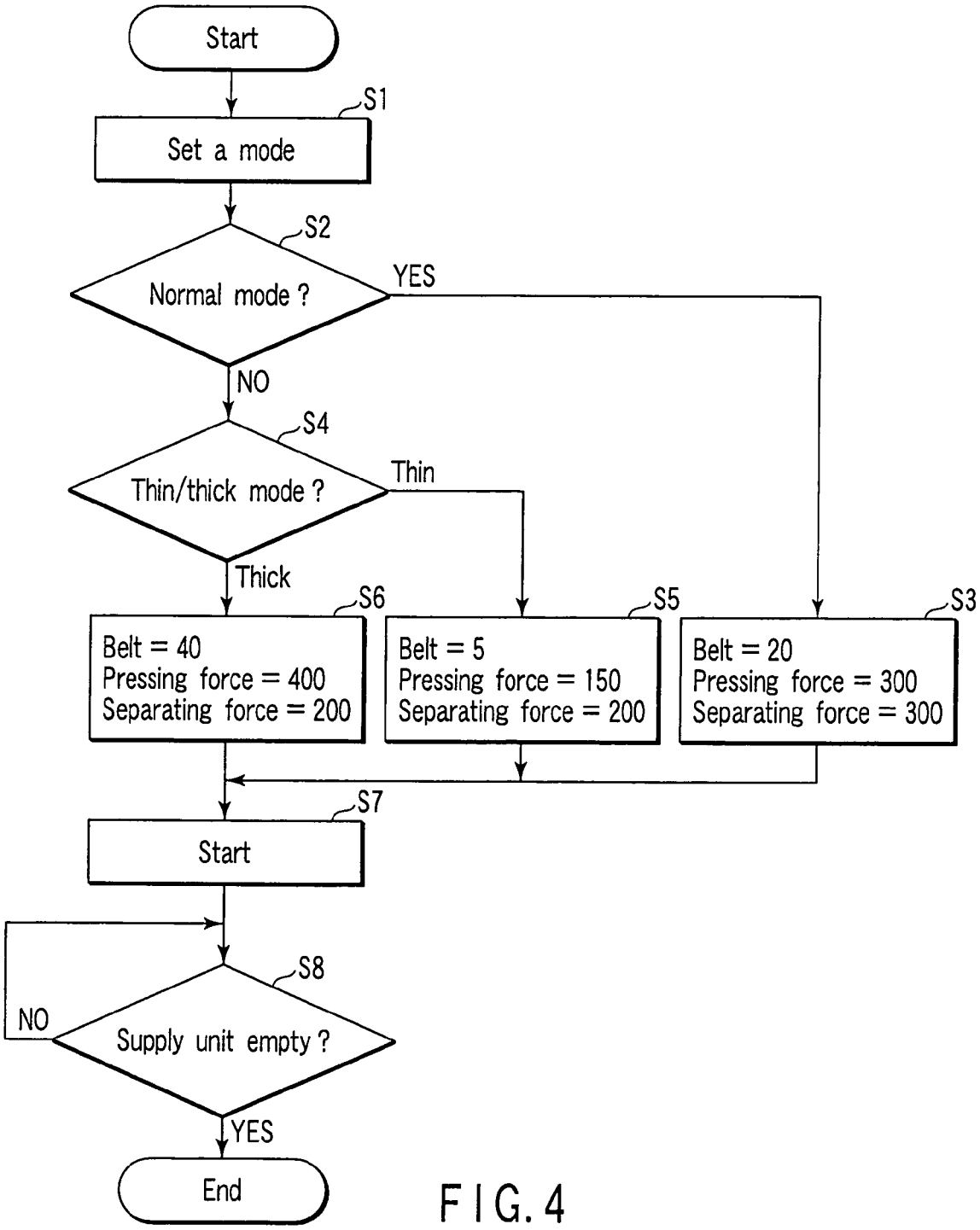
FIG. 4 is a flowchart of setting paper sheet takeout conditions of the same embodiment.

FIG. 4 is a flowchart of setting the paper sheet takeout conditions.

First, the operator selects and sets a processing mode suitable for the kind of paper sheet P to be supplied and handled, in the setting unit 25 according to the display "Select and Set Mode" in a not-shown display unit (step S1). The controller 29 determines whether the selected mode is a normal mode or not (step S2). When the selected mode is the normal mode, the control parameters for a normal mode are set (step S3), and the supplied paper sheets P can be continuously and stably taken out. A normal mode is selected when mixed various kinds of paper sheets P is supplied and handled. (A normal mode is default, and unnecessary to set again unless changed before.)

When the controller determines that the selected mode is not a normal mode in step S2, then the controller determines whether the selected mode is a thin or thick mode (step S4). When the selected mode is the thin mode, the control parameters for a thin paper sheet P are set (step S5), and supplied paper sheets P can be continuously and stably taken out. When a bulk of thin paper sheets P is supplied and handled, the thin mode is selected before the operator operates the apparatus.

When the controller determines that a thick mode is selected in step S4, the control parameters for a thick paper sheet P are set (step S6), and supplied paper sheets P can be continuously and stably taken out. When a bulk of thick paper sheets P is supplied and handled, a thick mode is selected before the operator operates the apparatus.

After setting parameters for a respective mode, press the start button (step S). The supply unit 1, delivery unit 2 and separation unit 3 are operated, and the paper sheet P is taken out and supplied. When the supply unit 1 becomes empty (step S8), the operation of taking out paper sheets is finished.

If thin media is supplied in a conventional apparatus with fixed control parameters (only in the normal mode in this embodiment), the media is supplied more than needed and as a result, the media is pressed to the delivering roller by a pressure larger than a predetermined value. The pressing force of the delivering roller is also applied to the media, the media is fed as a batch or in being overlapped if taken out in this state. Further, the separating force of the separating roller acts excessively, a paper jam occurs, and the apparatus stops for long time.

In this embodiment, the operator previously sets a thin mode, and the apparatus can handle thin paper sheets P.

If thick media is supplied in a conventional apparatus with fixed control parameters (only in a normal mode in this embodiment), it takes long time for the succeeding media to reach the delivering roller, and the processing efficiency is decreased. As the media is heavy, the delivering force of the delivering roller is not sufficiently transmitted to the media, and the processing efficiency is decreased. A separating force of the separating roller acts as resistance, and the processing efficiency is decreased.

In this embodiment, the operator previously sets a thick mode, and the apparatus can handle thick paper sheets P.

As described above, according to the paper sheet takeout apparatus of this embodiment, the operator previously selects one of the mode selector switches 26, 27 and 28 in the setting unit 25, and the processing efficiency is not decreased for any kind of media and stable takeout is possible.

Figure 5:
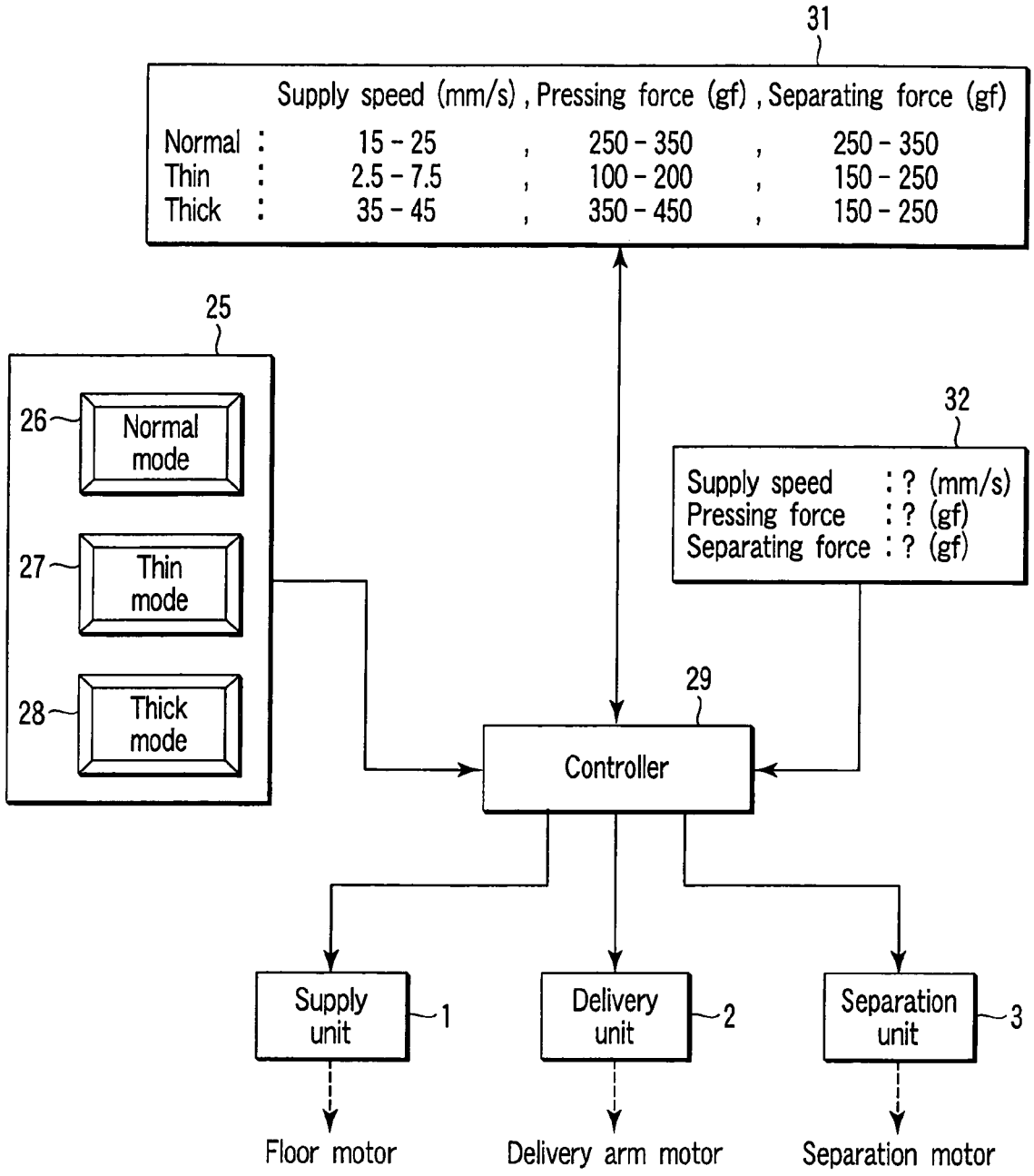
FIG. 5 is a block diagram of a control system for setting paper sheet takeout conditions of a second embodiment of the present invention.

FIG. 5 is a block diagram of the control system for setting paper sheet takeout conditions in a second embodiment of the present invention.

The same reference numerals are given to the same components as those shown in FIG. 3.

In the second embodiment, a memory 31 as a storage device previously stores tolerances of a supply speed instruction parameter to the floor motor 6, a pressing force instruction parameter to the delivery arm motor 17, and a separating force instruction parameter to the separation motor 23 for each processing mode. The embodiment also has an input unit 32 as a setting device to adjust and set parameter values within tolerances. Based on the parameter value entered in the input unit 32, the controller 29 controls the driving of the floor motor 6, delivery arm motor 17 and separation motor 23.

Concretely, a supply speed of 15-25 mm/s, a pressing force of 250-350 gf and a separating force of 250-350 gf are set for a normal mode. A supply speed of 2.5-7.5 mm/s, a pressing force of 100-200 gf and a separating force of 150-250 gf are set for the thin mode. A supply speed of 35-45 mm/s, a pressing force of 350-450 gf and a separating force of 150-250 gf are set in a thick mode.

Figure 6:
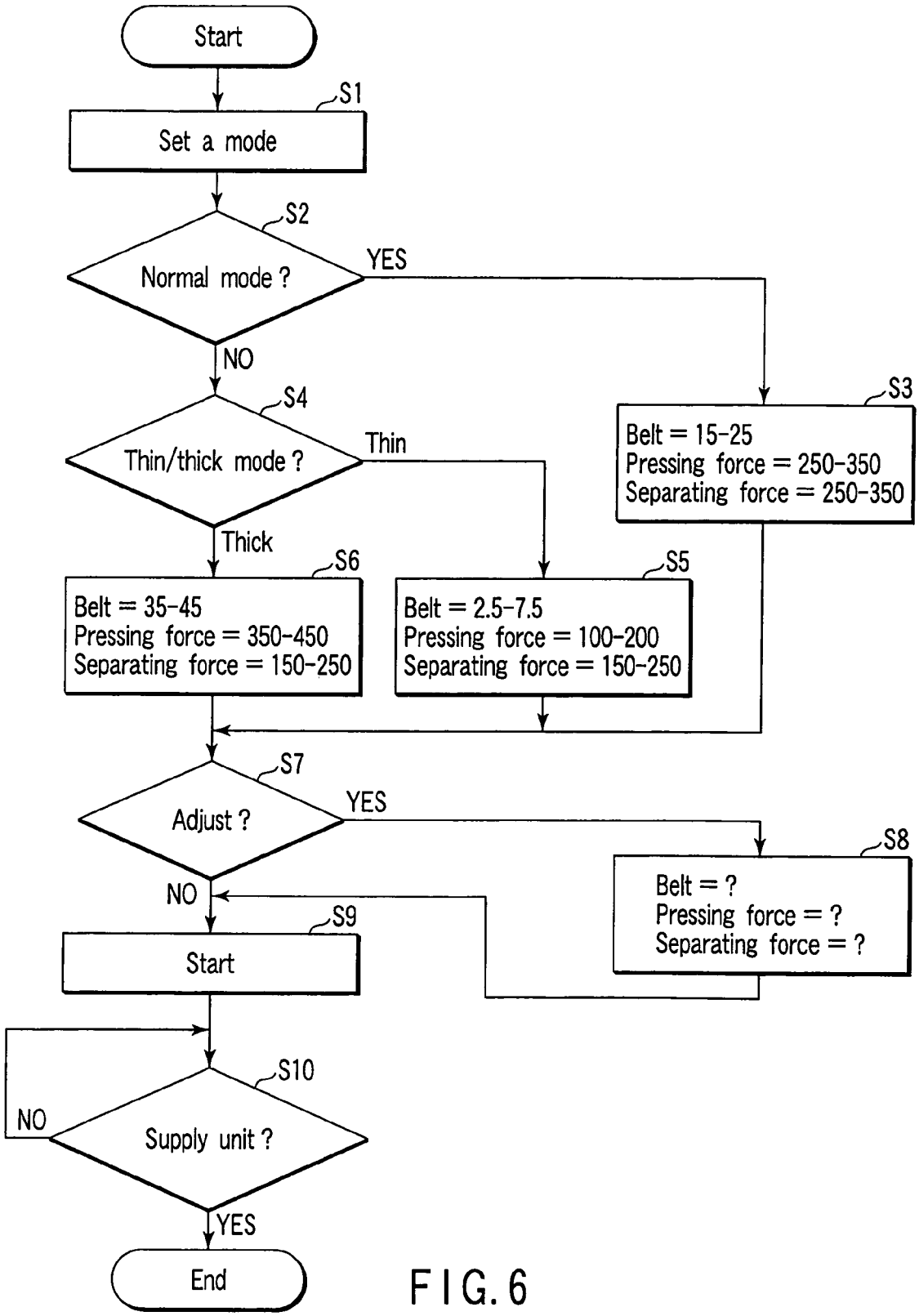
FIG. 6 is a flowchart of setting paper sheet takeout conditions of the same embodiment.

FIG. 6 is a flowchart of setting paper sheet takeout conditions.

In FIG. 6, steps S1-S6 are the same as those explained in FIG. 4, and explanation will be omitted.

When the operator selects a normal mode in the setting unit 25 and paper sheets set in the supply unit 1 are mixed various kinds including a high ratio of thick paper sheets (step S7), set parameters suitable for this condition in the input unit 32 (e.g., supply speed: 25 mm/s, pressing force: 350 gf, separating force: 300 gf). As a result, the control parameters for a normal mode are set suitable for a thick mode rather than a normal mode (step 8), and the supplied paper sheets P can be continuously and stably taken out.

If a ratio of thin paper sheets is high (step S7), set parameters suitable for this condition (e.g., supply speed: 15 mm/s, pressing force: 250 gf, separating force: 300 gf). As a result, the control parameters for a normal mode are set suitable for a thin mode rather than a normal mode (step S8), and the supplied paper sheets P can be continuously and stably taken out.

When supplying and handling a bulk of thin paper sheets P, selects a thin mode in the setting unit 25 before the operator operates the apparatus. If the supplied paper sheets P are thin but not very thin (step S7), set parameters suitable for this condition (e.g., supply speed: 7.5 mm/s, pressing force: 200 gf, separating force: 250 gf). As a result, the control parameters for a thin mode are set suitable for a normal mode rather than a thin mode (step S8), and the supplied thin paper sheets P can be continuously and stably taken out.

When supplying and handling a bulk of thick paper sheets P, selects a thick mode in the setting unit 25 before the operator operates the apparatus. If the supplied paper sheets P are thick but not very thick (step S7), set parameters suitable for this condition (e.g., supply speed: 35 mm/s, pressing force: 350 gf, separating force: 250 gf). As a result, the control parameters for a thick mode are set suitable for a normal mode rather than a thick mode (step S8), and the supplied thick paper sheets P can be continuously and stably taken out.

As described above, according to the paper sheet takeout apparatus of the second embodiment, the operator previously selects one of the mode selector switches 26, 27 and 28 in the setting unit 25, and enters control parameters within tolerances in the input unit 32. A processing efficiency is not decreased for any kind of media and stable takeout is possible.

Figure 7:
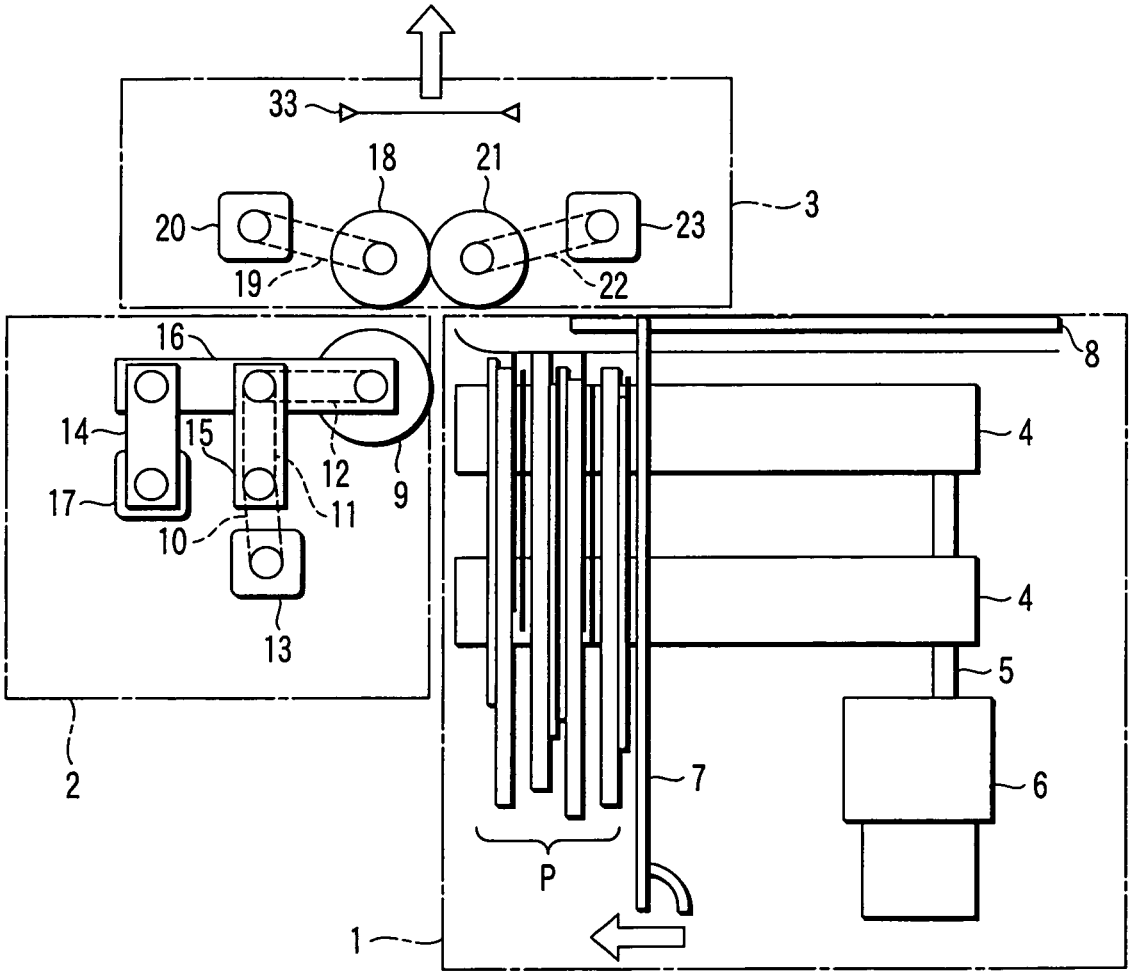
FIG. 7 is a plane view of a paper sheet takeout apparatus according to a third embodiment of the present invention.

FIG. 7 shows a paper sheet takeout apparatus according to a third embodiment of the present invention. The same components as those in FIG. 1 are given the same reference numerals, and explanation will be omitted.

In this embodiment, a sensor 33 as a detection device for detecting states of paper sheets is provided in the paper sheet delivering side of the separation unit 3.

Figure 8:
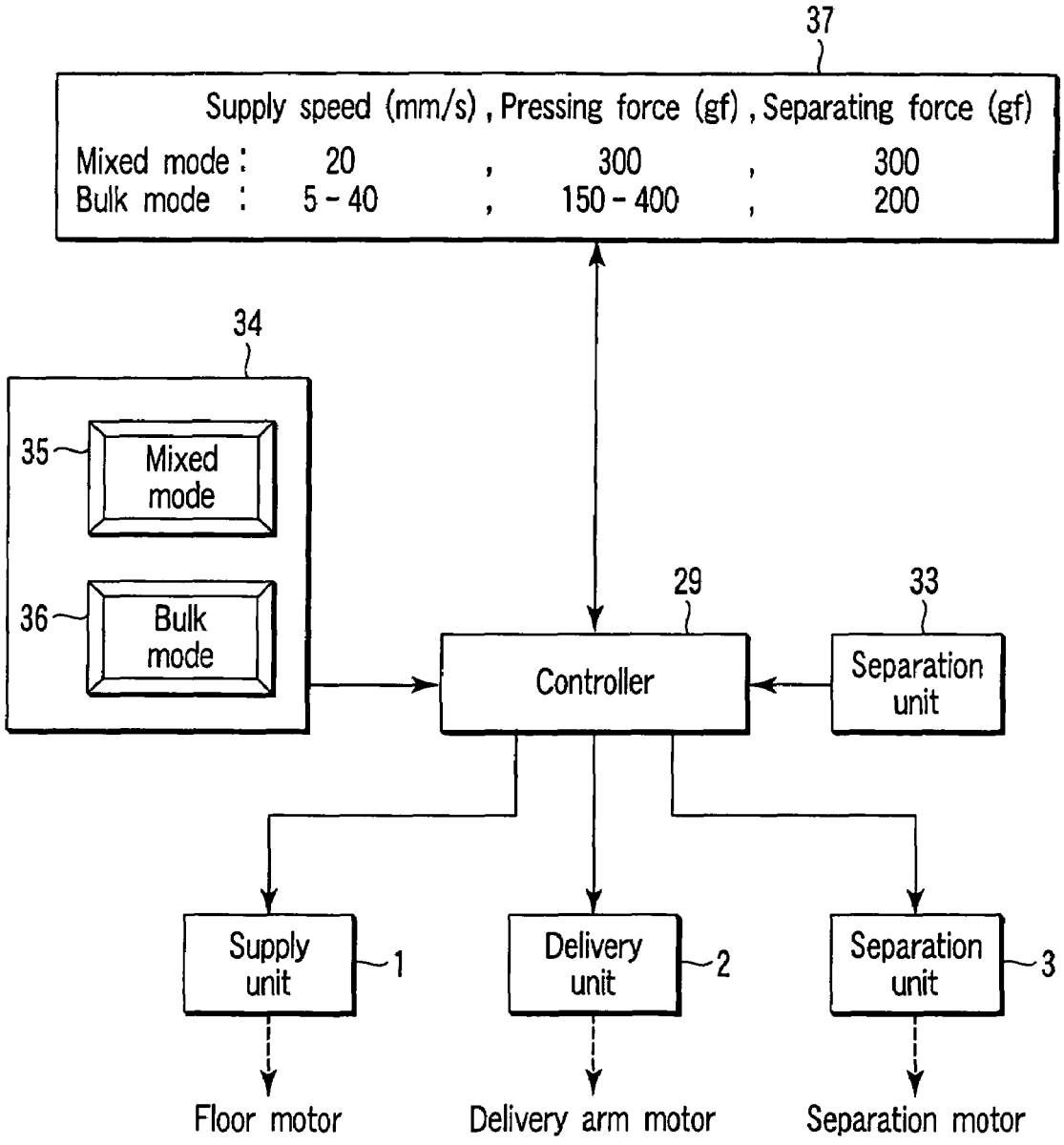
FIG. 8 is a block diagram of a control system for setting paper sheet takeout conditions of the same embodiment.

FIG. 8 is a block diagram of a control system for setting paper sheet takeout conditions. The same reference numerals are given to the same components as those shown in FIG. 3.

The sensor 33 is connected to the controller 29 through a signal circuit.

A setting unit 34 has a first selector switch 35 and a second selector switch 36. The first selector switch selects a mixed mode, and the second selector switch selects a bulk mode.

A mixed mode assumes that the apparatus handles various kinds of paper sheets P which are mixed and supplied. A bulk mode assumes that the apparatus handles a bulk of paper sheets P (only one kind). Usually, mixed paper sheets P are supplied and handled, and the default is a mixed mode.

When one of the first and second selector switches 35 and 36 is selected, the set information is sent from the setting unit 34 to the controller 29.

The state of paper sheet P detected with the sensor 33 is also sent to the controller 29. The state of paper sheet P mentioned here is a transfer gap of paper sheet P.

Based on the selection of processing modes in the setting unit 34, the supply speed instruction parameter to the floor motor 6, pressing force instruction parameter to the delivery arm 17 and separating force instruction parameter to the separation motor 23 for each processing mode stored in the memory 37 are set for a selected mode. Concretely, a supply speed of 20 mm/s, a pressing force of 300 gf and a separating force of 300 gf are set for a mixed mode. A supply speed of 5 mm/s, a pressing force of 150 gf and a separating force of 200 gf are set for a bulk mode.

The control parameter settings for a mixed mode are values adjusted to be able to handle various kinds of paper sheets P evenly, and considered fixed values.

The control parameter settings for a bulk mode are values suitable for handling thin media, and have tolerances (supply speed 5-40 mm/s, pressing force 150-400 gf, separating force 200 gf). Based on this setting information, the controller 29 variably controls the floor motor 6, delivery arm motor 17 and separation motor 23.

Figure 9:
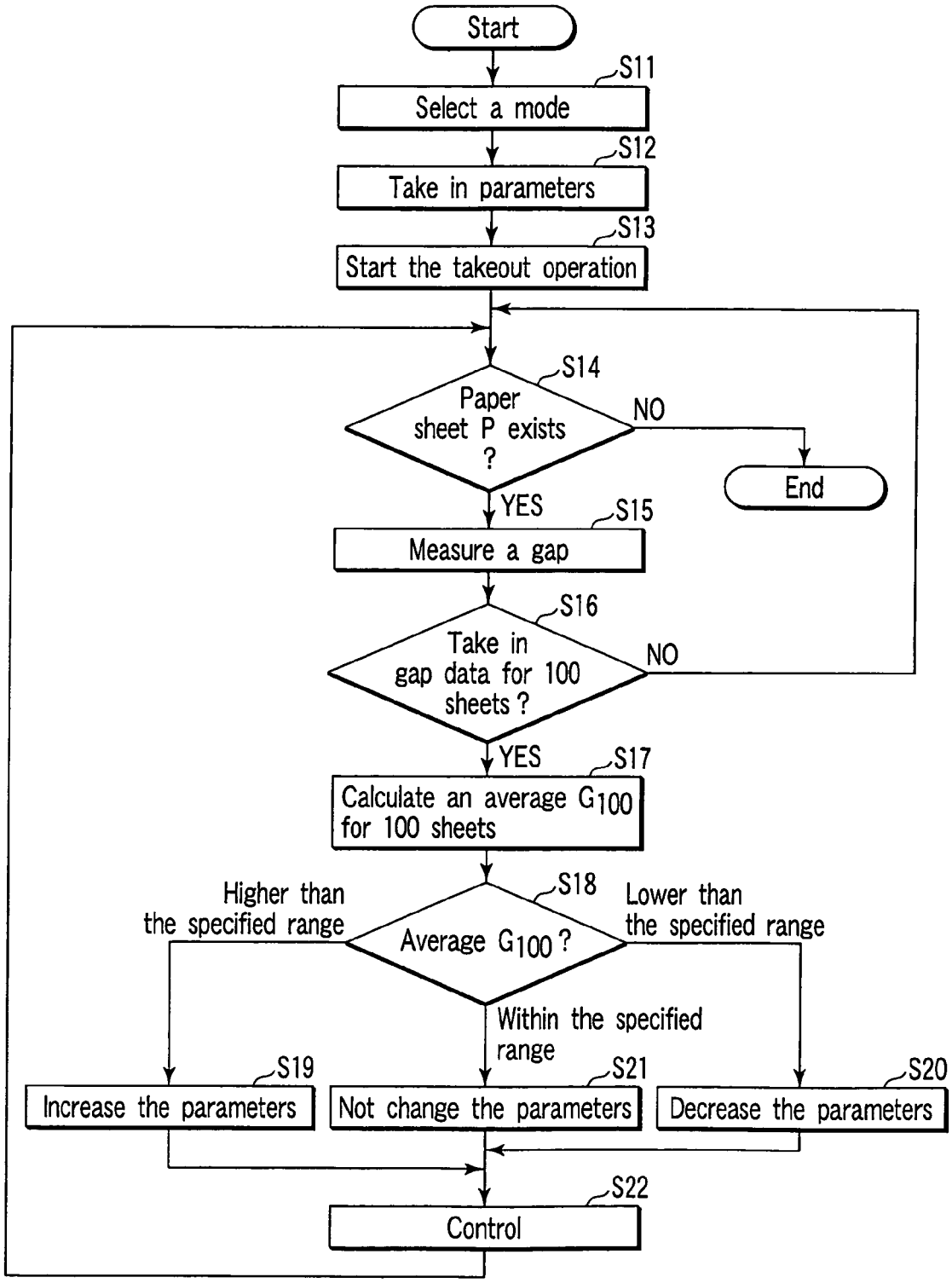
FIG. 9 is a flowchart of setting the paper sheet takeout conditions of the same embodiment.

FIG. 9 is a flowchart of setting paper sheet takeout conditions.

First, the operator selects a processing mode suitable for the kind of paper sheet P to be supplied and handled, in the setting unit 34 (step S11). Select a mixed mode when supplying and handling mixed various kinds of paper sheets P. (The default is a mixed mode, and this operation is unnecessary unless the mode is changed before.) As a result, control parameters for a mixed mode are set (step 12), and the takeout operation is started (step S13). The supplied paper sheets P can be continuously and stably taken out. At the end of the takeout operation, whether any paper sheet P remains in the supply unit 1 is checked (step S14). If no paper sheet P remains, the takeout operation is finished.

Figure 10A:
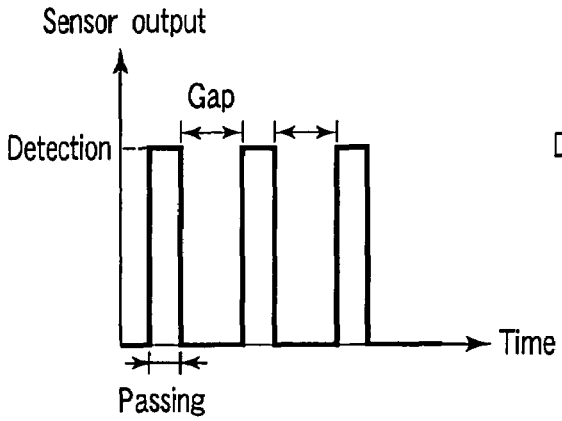
FIG. 10A is a view showing a sensor output in the same embodiment.

Select a balk mode before the operator operates the apparatus, when supplying and handling a bulk of paper sheets P (step S11). The takeout operation is started with the control parameters for thin media preset as initial values. As the control parameters for thin media are set, a gap is optimum as shown in FIG. 10A and smooth takeout is possible.

Figure 10B:
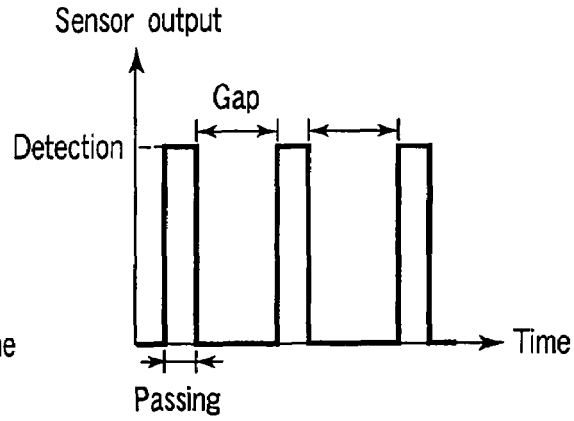
FIG. 10B is a view showing a sensor output in the same embodiment.
Figure 11A:
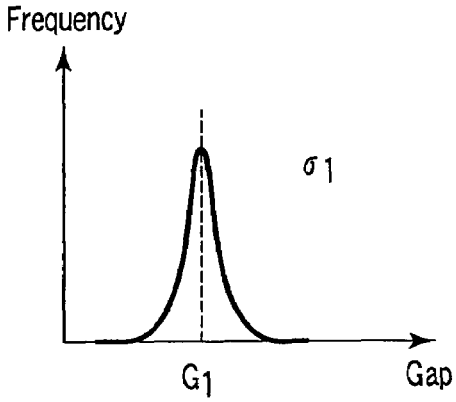
FIG. 11A is a view showing variations in a gap between paper sheets in the same embodiment.
Figure 11B:
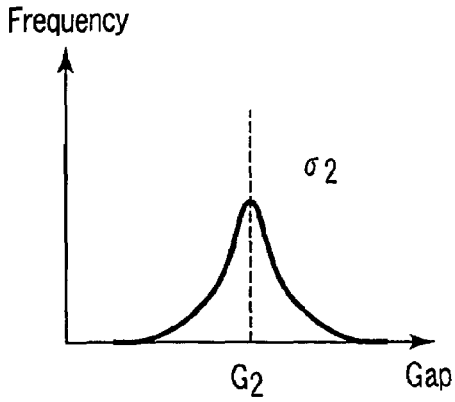
FIG. 11B is a view showing variations in a gap between paper sheets in the same embodiment.
Figure 12A:
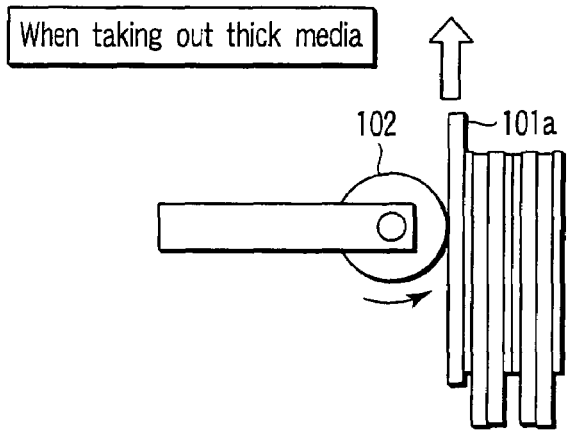
FIG. 12A PRIOR ART
FIG. 12A is a view showing an operation of taking out thick paper sheets in a conventional apparatus.
Figure 12B:
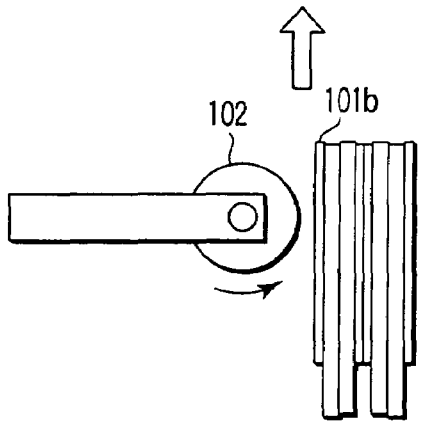
FIG. 12B PRIOR ART
FIG. 12B is a view showing an operation of taking out thick paper sheets in a conventional apparatus.
Figure 13A:
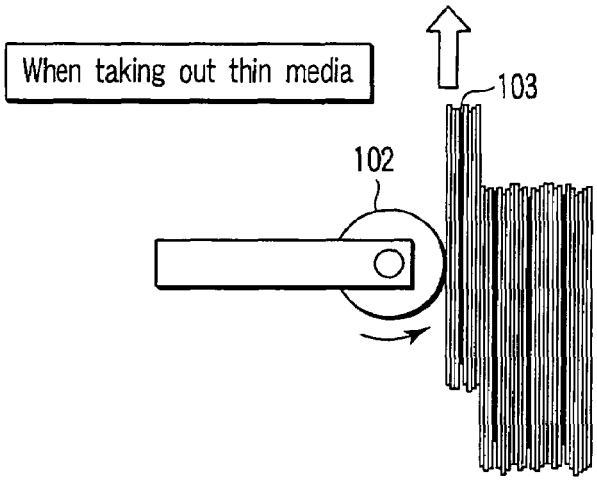
FIG. 13A PRIOR ART
FIG. 13A is a view showing an operation of taking out thin paper sheets in a conventional apparatus.
Figure 13B:
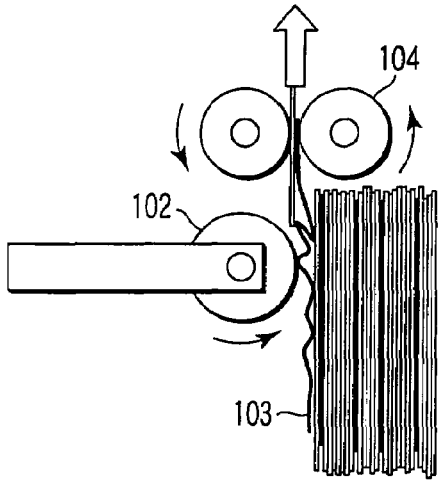
FIG. 13B PRIOR ART
FIG. 13B is a view showing an operation of taking out thin paper sheets in a conventional apparatus.

However, a gap increases and varies for thick media as shown in FIG. 10B. Namely, when processing a gap statistically, an average value of gap is G1<G2 and a standard deviation is $\sigma 1<\sigma 2$ as shown in FIGS. 11A and 11B.

In this embodiment, a gap between paper sheets P delivered from the separation unit 3 is measured with the sensor 33 (step S15), and average and standard values are calculated (step 17) when a gap is measured for a predetermined number of paper sheets (e.g., 100). If average and standard values exceed specified values (step S18), the parameters are increased to increase a supply speed and a pressing force (step S19), and the floor motor 6 and delivery arm motor 17 are variably controlled. Thus, the control parameters are automatically adjusted until the average gap and standard deviation reach specified values, and appropriate values are set for thick media.

When a bulk of thin media is supplied after appropriate values are set for thick media, the average gap and standard deviation decrease to be lower than specified values. In this case, contrarily to the above, the parameters are decreased to decrease a supply speed and a pressing force (step S20), and the floor motor 6 and delivery arm motor 17 are variably controlled. As a result, appropriate values are set for thin media.

When a gap is within a specified range, the parameters are unchanged (step S21) and the floor motor 6 and delivery arm motor 17 are variably controlled (step S22).

According to the paper sheet takeout apparatus of the third embodiment, the operator previously determines states (mixed/bulk) of media to be handled, and selects one of the selector switches 35 and 36 in the setting unit 34. A processing efficiency is not decreased for any kind of media, and stable takeout is possible.

In the embodiments 1 to 3, only one separation unit 3 comprising a feeding roller 18 and a separating roller 21 is provided, but two or more separation units 3 may be provide.

In the embodiments 1 to 3, the controller 29 controls the floor motor 6, delivery arm motor 17 and separation motor 23, based on the selection of modes in the setting unit 25. It is effective to control any one of the floor motor 6, delivery arm motor 17 and separation motor 23.

In the above embodiments, thin and thick modes are provided in addition to a normal mode. The number of modes is not limited to the three. Modes may also be switched according to the weight of paper sheets.

It is permitted to add a mode for a special medium. It is also permitted to decrease the number of modes, for example, only one for thin or thick media. An essential point is to have a mode other than a normal mode.

In the third embodiment, a gap between paper sheets is detected with the sensor 33. The same effect can be obtained by detecting the number of paper sheets per unit time and controlling based on the detected value.

The invention may be embodied in other specific forms without departing from its spirit or essential characteristics.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A paper sheet takeout apparatus comprising:

a supply device which supplies a stack of paper sheets in a stacking direction;

a delivering roller which contacts paper sheets supplied from the supply device, rotates and delivers the paper sheets;

a pressure device which presses the delivering roller to the paper sheets;

a feeding roller which rotates in a first direction and feeds the paper sheets delivered from the delivering roller;

a separating roller which is pressed by the feeding roller, given a rotation torque in a second direction reverse to the first direction, and separates the paper sheets;

a storage device which has several processing modes, and stores parameters of a supply speed of the supply device, a pressing force of the pressure device and a separating force of the separating roller for each processing mode;

a mode selector device which selects one of the processing modes; and a control device which reads the parameters from the storage device in accordance with the processing mode selected by the mode selector device and which controls supply speed of the supply device; a pressing force of the pressure device and a separating force of the separating roller, based on the parameters read from the storage device.

2. The paper sheet takeout apparatus according to claim 1, wherein the several processing modes include a normal mode for handling mixed various kinds of paper sheets, a thin mode for handling only thin paper sheets, and a thick mode for handling only thick paper sheets.

3. The paper sheet takeout apparatus according to claim 1, wherein the storage device stores, as tolerances, parameters which indicate the supply speed of the supply device, the pressing force of the pressure device and the separating force of the separating roller, and enable processing in each of the processing modes.

4. The paper sheet takeout apparatus according to claim 3, wherein the several processing modes include a normal mode for handling mixed various kinds of paper sheets, a thin mode for handling only thin paper sheets, and a thick mode for handling only thick paper sheets.

5. The paper sheet takeout apparatus according to claim 1, further comprising a detection device which detects states of paper sheets separated and fed from the separating roller, and wherein the control device adjusts the parameters read from the storage device in accordance with the detected states of the paper sheets, and controls the supply speed of the supply device, the pressing force of the pressure device, and the separating force of the separating roller based on the adjusted parameters.

6. The paper sheet takeout apparatus according to claim 5, wherein the several processing modes include a normal mode for handling mixed various kinds of paper sheets, and a bulk mode for handling one kind of paper sheets.

7. The paper sheet takeout apparatus according to claim 5, wherein the detection device detects a gap between the fed paper sheets.

8. The paper sheet takeout apparatus according to claim 5, wherein the detection device detects an average gap between a predetermined number of paper sheets fed to the detection device.

* * * * *